US005090735A

United States Patent [19]

Meaney et al.

[11] Patent Number: 5,090,735

[45] Date of Patent: Feb. 25, 1992

[54] SEASONAL GAME

[75] Inventors: Stacey B. Meaney; Gregory J. Meaney, both of Bedminster, N.J.; David W. Schropfer, Stamford; Harold L. Rogers, Bridgeport, both of Conn.

[73] Assignee: Meaney Enterprises, Inc., Bedminster, N.J.

[21] Appl. No.: 692,235

[22] Filed: Apr. 26, 1991

[51] Int. Cl.[5] ..... B42D 15/00; A63F 9/00

[52] U.S. Cl. ..... 283/67; 283/63.1; 283/49; 273/94; 273/148 R; 273/277

[58] Field of Search ..... 273/148 R, 94, 85 R, 273/1.5 R, 55 R, 236, 240, 277, 285, 286, 298, 281, 282, 274, 88, 138 R; 283/48.1-52.1, 63.1, 101, 81, 67; 434/242-252

[56] References Cited

U.S. PATENT DOCUMENTS

| | | | |
|---|---|---|---|
| 758,808 | 5/1904 | Bach | 283/49 |
| 1,431,577 | 10/1922 | Feihl | 283/49 |
| 1,932,524 | 10/1933 | Jackson | 273/240 |
| 2,131,825 | 10/1938 | Sultzer | 273/94 R |
| 3,397,886 | 8/1968 | Dopieralski | 283/49 X |
| 3,698,741 | 10/1972 | Beebe | 283/63.1 |
| 3,760,520 | 9/1973 | Hamilton | 283/63.1 X |
| 4,019,737 | 4/1977 | Witzel | 273/94 |
| 4,102,543 | 7/1978 | Smith | 283/49 |
| 4,141,548 | 2/1979 | Everton | 273/94 |
| 4,601,490 | 7/1986 | Brandon | 273/240 X |
| 4,662,635 | 5/1987 | Enokian | 273/94 |
| 4,722,526 | 2/1988 | Tovar et al. | 273/94 X |
| 4,815,767 | 3/1989 | Lambert | 283/81 X |
| 4,918,603 | 4/1990 | Hughes et al. | 273/94 X |
| 4,953,873 | 9/1990 | Jacobson | 273/94 X |
| 5,018,736 | 5/1991 | Pearson et al. | 273/439 |
| 5,031,937 | 7/1991 | Nellhaus | 283/52.1 |

FOREIGN PATENT DOCUMENTS

| | | | |
|---|---|---|---|
| 1604651 | 12/1981 | United Kingdom | 283/51 |

*Primary Examiner*—Edward M. Coven
*Assistant Examiner*—Sebastiano Passaniti
*Attorney, Agent, or Firm*—Perman & Green

[57] ABSTRACT

A game which combines skill and chance is disclosed for one or more players. According to the game, each player chooses, beforehand, the outcomes of actual athletic contests. The athletic contests are played in the course of a playing season by existing teams belonging to existing leagues. There are weekly contests, playoff contests, and a championship contest. Each player records his own choices and successes in a bound booklet preprinted with the opposing teams for each of the weekly contests, for the playoff games, and for the championship contest. A group record is kept on a board containing the names of each of the players, and provision for manually inserting the total number of successful choices of each player for each successive week, the cumulative successful choices of each player for all of the preceding weeks of the contest season continuing through the playoffs and concluding with the championship contest. Markers with pressure sensitive adhesive are provided for keeping track of individual contest winners, also, winners for the week and for the season.

12 Claims, 6 Drawing Sheets

SEASONAL GAME

BACKGROUND OF THE INVENTION

1. Field of the Invention

The present invention relates to a game which combines skill and chance for participants who seek to correctly select, beforehand, the winners of actual athletic contests played by a plurality of teams belonging to a league in the course of a playing season which involves weekly contests, playoff contests, and a championship contest.

2. Description of the Prior Art

Numerous board games and even computerized games have been devised to simulate athletic contests. As such, they commonly involve a continuing series of events representing a single contest, or game, and concluding with a winner at the end of that contest. The action customarily takes place over a brief period of time, often less than an hour in duration and seldom continued into a second day.

It has also been known for individuals, in competition with other individuals, to select winners of one or more athletic contests which occur on a particular day or over a limited period of time, for example, during the course of a week.

Both of these forms of leisure activity have brought hours of enjoyment to their participants.

It was in an effort to further improve upon the enjoyment of such known activities that the present invention has been conceived and is now reduced to practice.

SUMMARY OF THE INVENTION

The present invention relates to a game which combines skill and chance and provides for participation by one or more players. According to the game, each player selects, beforehand, the winners of actual athletic contests. The athletic contests are played in the course of a playing season by existing teams belonging to existing leagues. There are weekly contests, playoff contests, and a championship contest. Each player records his own selections and successes in a bound booklet preprinted with the opposing teams for each of the weekly contests, for the playoff games, and for the championship contest. A group record is kept on a board containing the names of each of the players, and there is provision for manually inserting the total number of successful choices of each player for each successive week, the cumulative successful choices of each player for all of the preceding weeks of the contest season continuing through the playoffs and concluding with the championship contest. Markers with pressure sensitive adhesive are provided for keeping track of individual contest winners, also, winners for the week and for the season.

The athletic contests may be in the nature of football, baseball, basketball, hockey, soccer, or other athletic contests employing a number of members forming a team. Also, in keeping with the invention, a number of such teams would comprise a league and multiple contests would be engaged among those teams over a period of time comprising a season. The teams may represent educational entities such as schools or universities, or geographical entities such as cities, states, or regions.

One object of the invention is to provide a game which combines skill and chance for participation by one or more players who seek to correctly select, beforehand, the outcomes of an actual athletic contests played by a plurality of teams belonging to a league in the course of a playing season.

Another object of the invention is to provide such a game which can be played for enjoyment alone or for enjoyment coupled with awards for correct selections made by the players.

Still another object of the invention is to provide a game which continues for an extended period of time.

Yet a further object of the invention is to provide a board game which is played simultaneously with, and reflects, the contests being played by a series of seasonal athletic contests.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENTS

Figure 1:
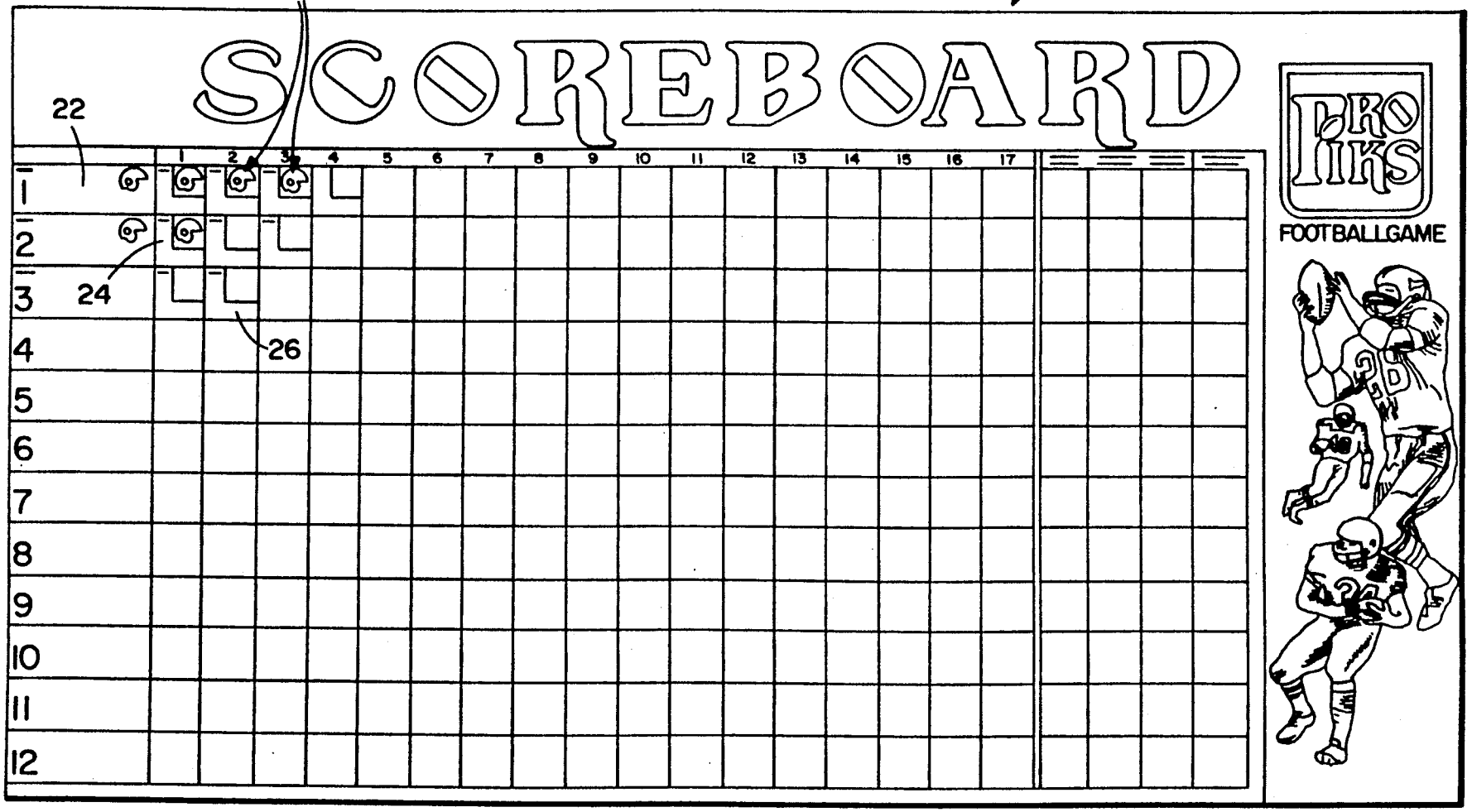
FIG. 1 is an illustration of the scoreboard for use with the game of the invention.

Turn now to the drawings and, initially, to FIG. 1 which illustrates a score board 20 for use with the novel game being disclosed. As noted before, the game utilizing the score board 20 combines elements of skill and chance for participation by one or more players who seek to correctly select, beforehand, the winners of actual athletic contests played by a plurality of teams belonging to a league in the course of a playing season which involves weekly contests, playoff contests, and a championship contest. The actual athletic contests may be games of football, baseball, basketball, hockey, soccer, or other athletic contests which employ multiple teams comprising a league and multiple contests among those teams over a period of time which constitutes a season. The teams may represent educational entities such as schools or universities or geographical entities such as cities, states, or regions. In the latter event, it is conceivable that they could be either amateurs or professionals. For ease of explanation but without intending to restrict the scope of the invention, the description herein will be limited to a game involving professional football.

Figure 2:
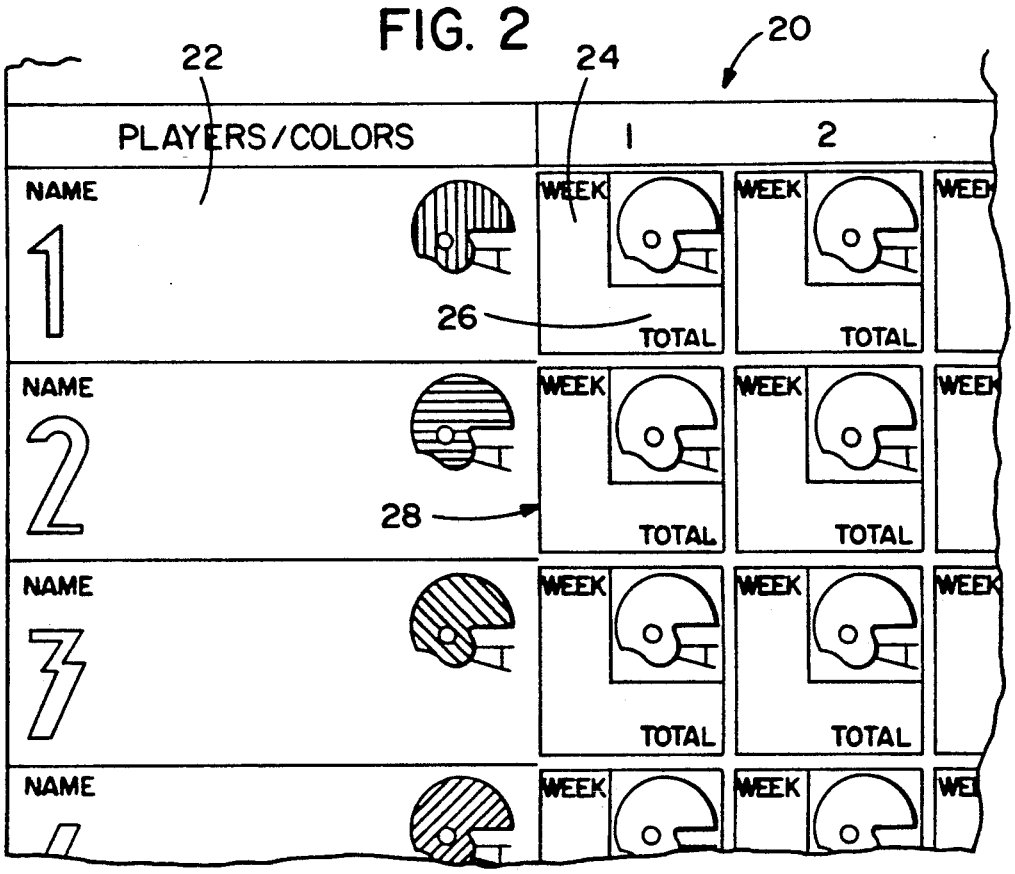
FIG. 2 is a detail view illustrating a part of the scoreboard of FIG. 1.

In any event, the scoreboard 20 serves to provide a comprehensive view of the progress of the game being disclosed and of the relative successes of the players of the game. The scoreboard 20 may be made of any suitable material such as paper, cardboard, vinyl, plastic or the like and is of an adequate size to clearly display all of the information intended to be displayed. The scoreboard 20 includes a plurality of indicated locations 22 which may be sequentially numbered, as depicted, for manually inserting the names of each of the players. At other indicated locations 24 (for increased clarity, see FIG. 2) the total number of successful choices of each player for each successive week is manually inserted. At still other indicated locations 26, the cumulative successful choices of each player for all of the preceding weeks of the contest season continuing through the playoffs and concluding with the championship contest are similarly manually inserted. Each box 28 on the scoreboard serves to display the success achieved by each player at the conclusion of a week's events. Along the top of the scoreboard are indicated the numbered weeks of the regular playing season followed by the playoff weeks and concluding with the championship week or contest. While 17 weeks are indicated for the regular season play and 4 weeks are indicated for post season play, these are merely shown by way of example and may be different in any given instance.

The game being disclosed can be played in a number of different ways and only some of these ways will be described, although it will be understood that many others are within the scope of the invention.

During the off season, that is, when the actual athletic contests on which the game being disclosed is based are not being played, an appropriate leader contacts other people who may wish to play the game. It is desirable for those people, the forthcoming players of the game, to meet at least one week before the first regular season contests. At such a meeting, the players receive their appropriate gear, to be described, acquaint themselves with the rules of the game, select from their group a head coach and a referee, and select a color for each player which will be retained for the entire season. Regular play of the game is preferred for two to six players although the scoreboard 20 is designed for up to twelve players and additional scoreboards could be used if play is to involve still more players. In another instance, it may be desirable for only one or only two players to play. In the latter events, it would not be necessary to select a head coach or a referee.

The purpose of the head coach, who is also a player, is to keep track of each player's score on the scoreboard 20. In a preferred manner of play, the head coach receives, in writing, a player's choices for the athletic contests before those contests begin. Indeed, it may be a rule that he or she must obtain those selections by noon of the first day of each week's contests, the first day typically being a Sunday. The head coach may receive the selections in person, or via other delivery means provided before the first day of each week's contests, or in some other appropriate manner by reason of which a player's selections are complete and final prior to the contests themselves.

The referee, who is also a player, assures the accuracy of the head coach by checking his or her selections. Additionally, the referee settles all disputes based on the instruction manual.

In a preferred manner of play, a player who disagrees with the referee's decision may appeal to the head coach who, in turn, puts the dispute to a vote of all of the other players, including the referee. If a majority prevails, all players must then play according to the revised rule. The head coach only votes to break a tie vote.

Figure 3:
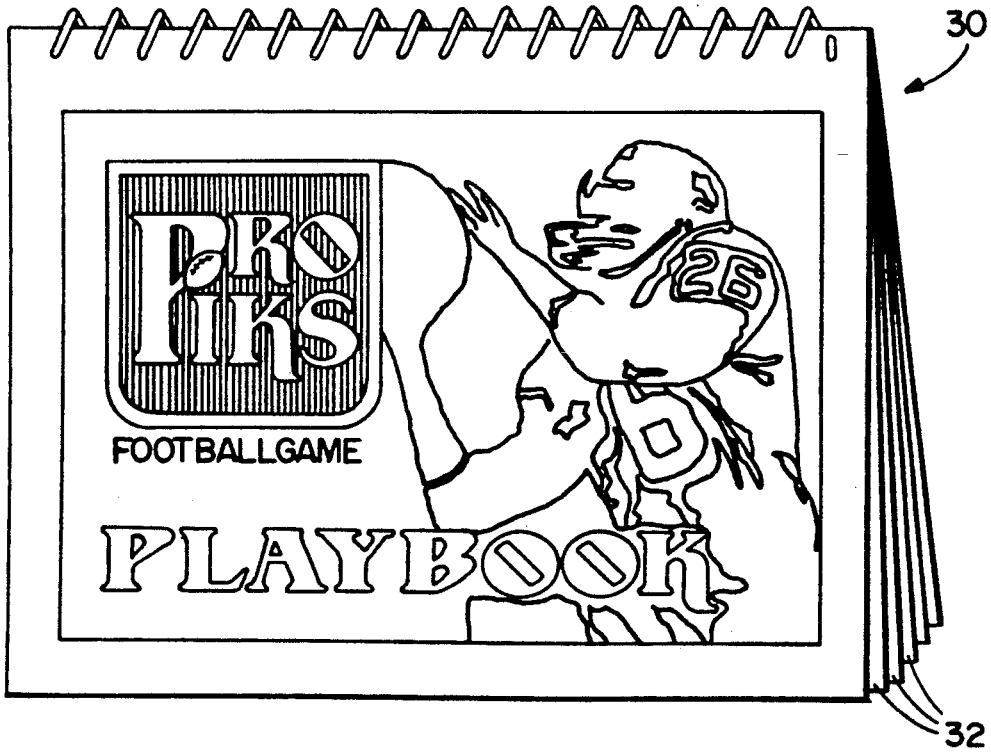
FIG. 3 is a perspective view of a play action guide in the form of a booklet utilized for play of the game of the invention.
Figure 4:
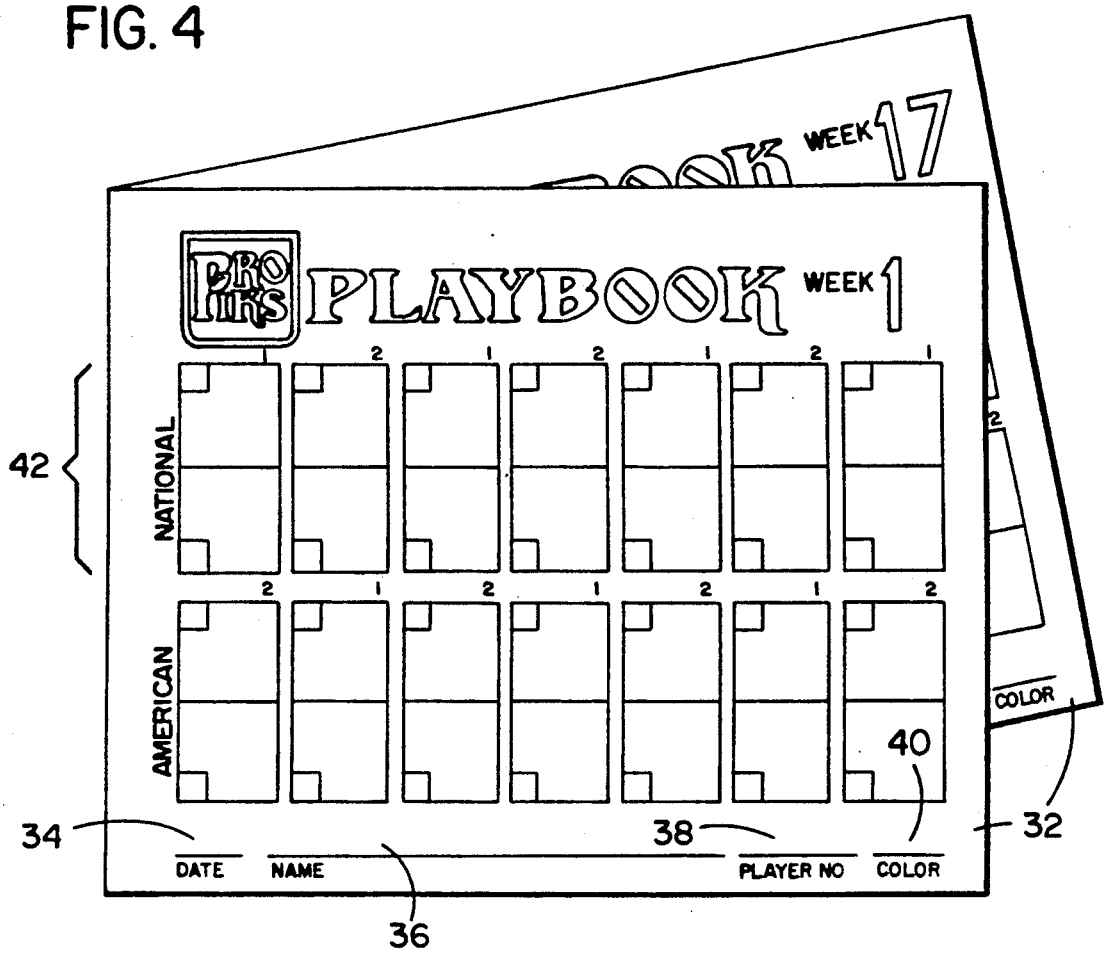
FIG. 4 illustrates those successive pages of the play action guide of FIG. 3 intended for regular season play.
Figure 5:
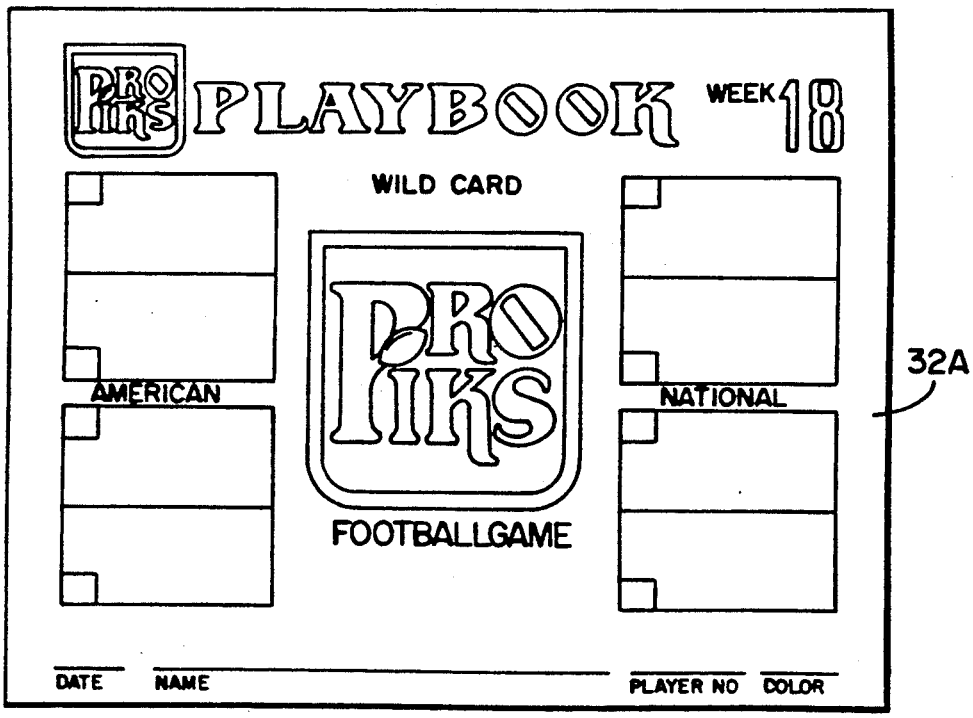
FIG. 5 illustrates a page of the play action guide intended for the wild card playoff contests.
Figure 6:
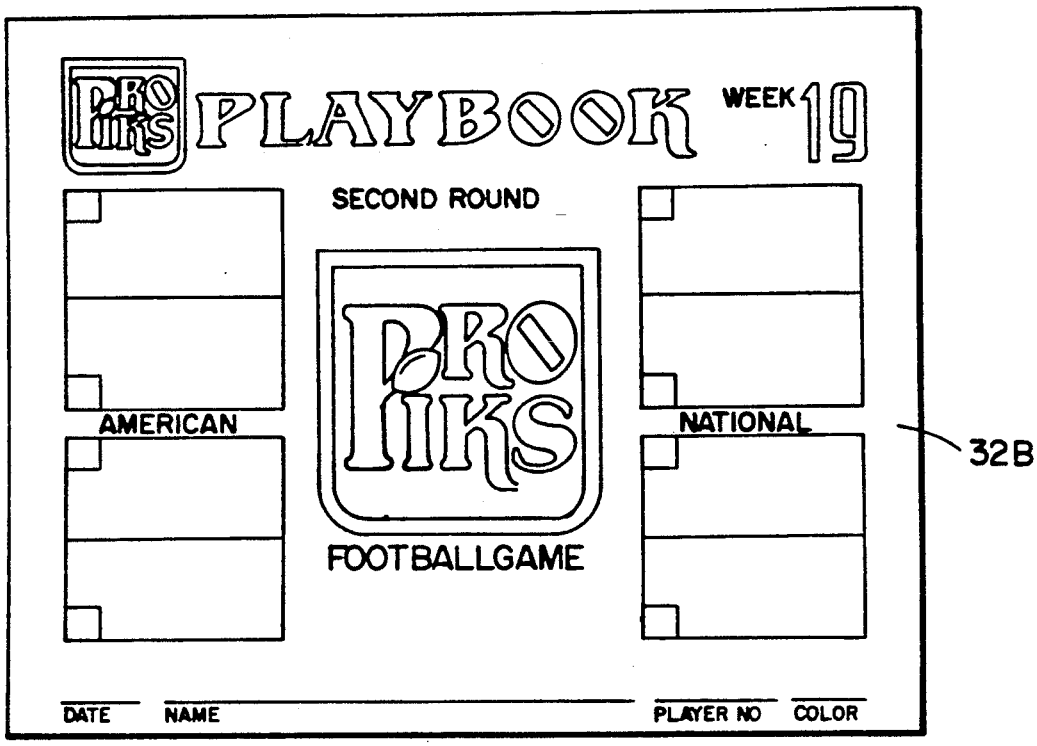
FIG. 6 illustrates a page of the play action guide intended for a second round of the playoff contests.
Figure 7:
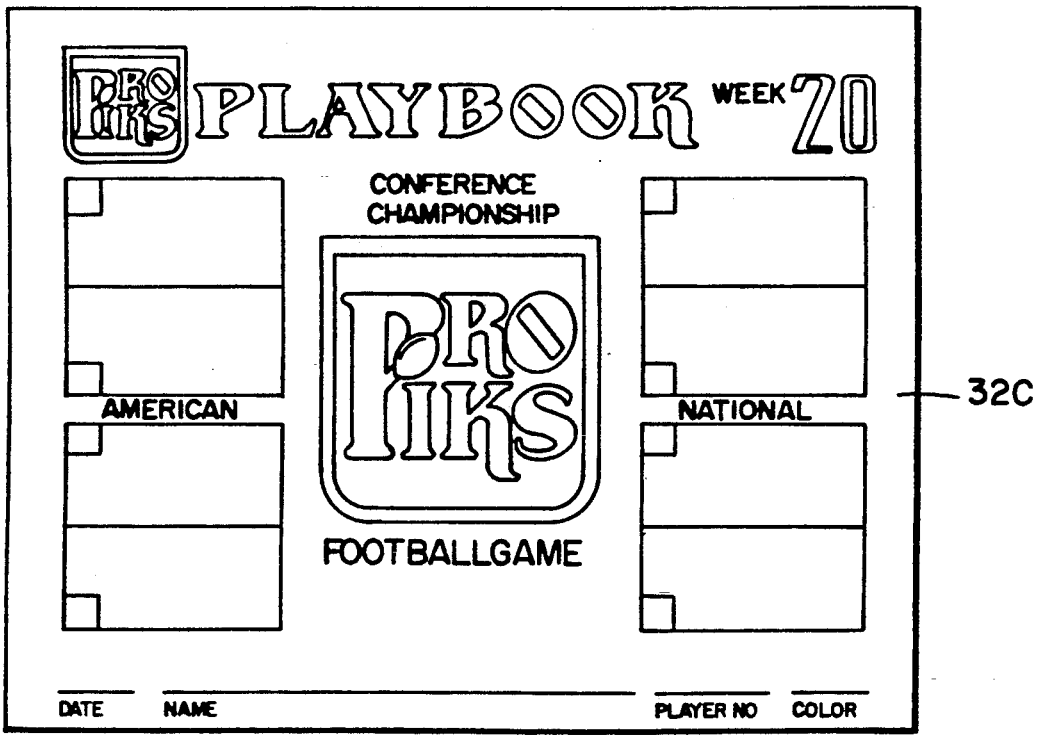
FIG. 7 illustrates another page of the play action guide intended for conference championship contests.
Figure 8:
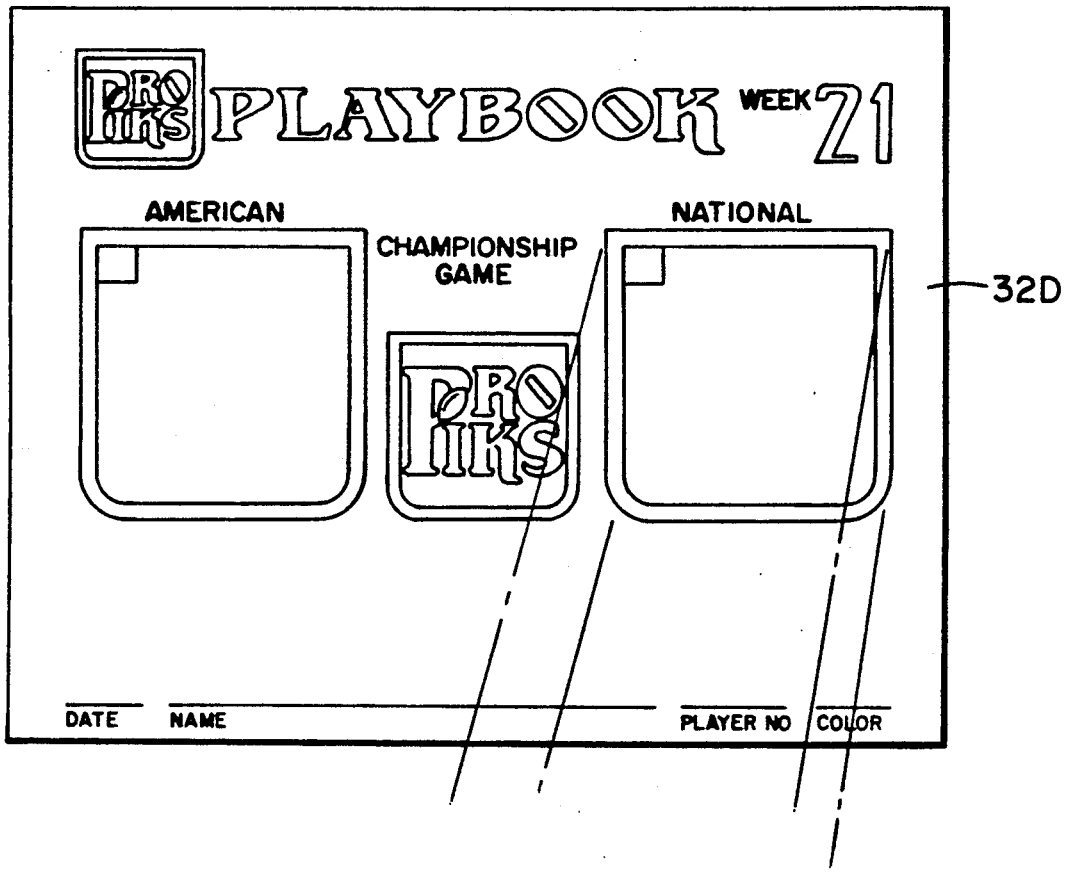
FIG. 8 illustrates a page of the play action guide intended for the championship game of the season.
Figure 8A:
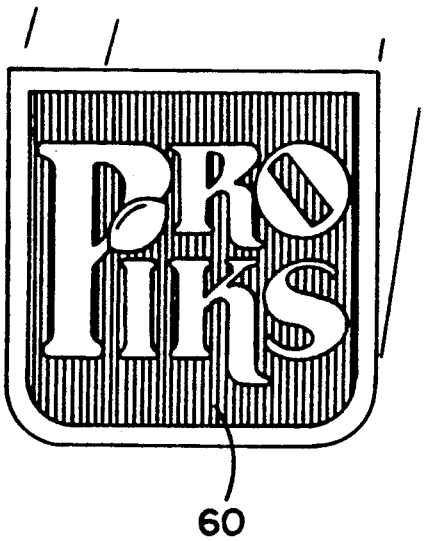
Figure 9:
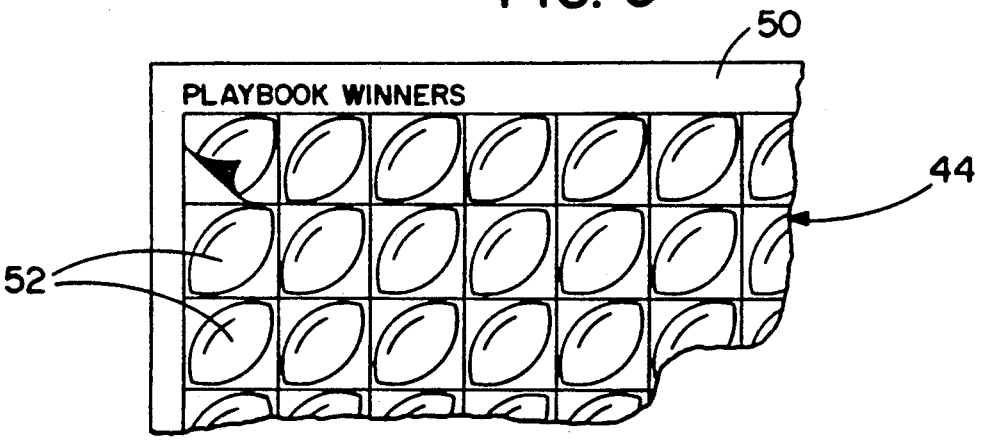
FIG. 9 indicates a sheet of football markers for use with the game of the invention.
Figure 10:
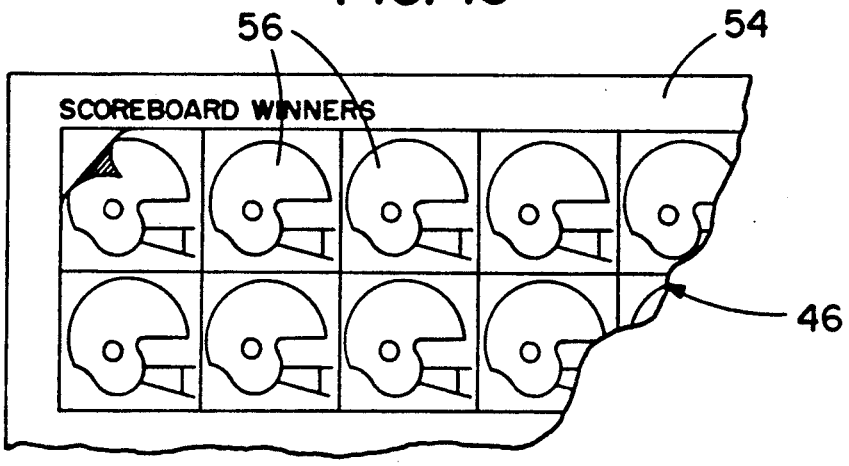
FIG. 10 illustrates a sheet of helmet markers for use with the game of the invention.
Figure 11:
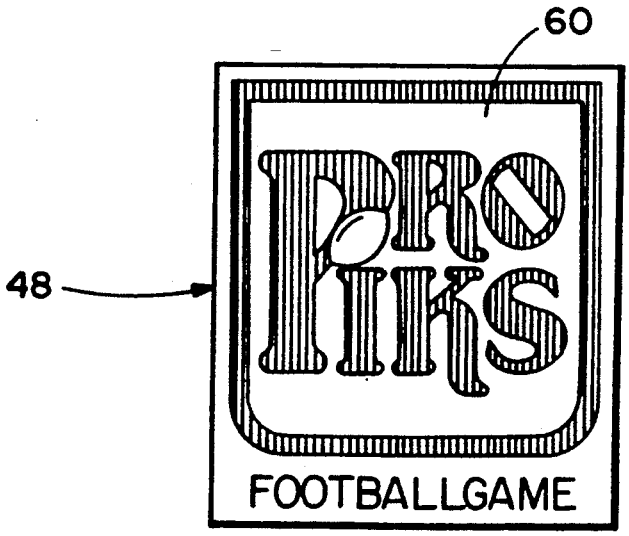
FIG. 11 illustrates a sheet including a shield marker for use with the game of the invention.

The gear, or items required for play, mentioned earlier as being provided to each of the players, will now be described. As seen in FIG. 3, primary item is a play action guide 30 which is a booklet, preferably bound to enable a player to easily turn its pages 32. The pages are sequentially numbered for the weeks of the season, 17, for example, as seen in FIG. 4, and indicate the opposing teams, or match-ups, for each of the contests scheduled for that week. Page 32A (FIG. 5) of the play action guide 30 is provided for wild card playoff contests, page 32B (FIG. 6) for the second round playoff contests, page 32C (FIG. 7) for the conference championships as well as pages 32D (FIG. 8) for the championship contest. Of course, it will be understood that the specific names of the contenders in the playoff contests and in the championship contest cannot be provided on the pages 32A, 32B, 32C, or 32D since they are not known at the time that the play action guide 30 is printed. There are indicated locations for the manual insertion of information on each of the pages 32.

Specifically, turning back to FIG. 4, on each page 32, there is an indicated location 34 for the date, an indicated location 36 for the player's name, an indicated location 38 for the player's number, and an indicated location 40 to indicate the color chosen by the player. The latter two items of information may be considered optional. The pages 32 which portray the regular season contests depict 14 such contests for each week. A player would select his choice as winner for each contest by placing an appropriate mark such as an "x", in each appropriate box 42 depicting the team of his choice. A mark would be applied by means of a pen or other suitable instrument utilizing an indelible ink or other form of permanent marking. After completing the marking of all of the weekly games depicted, for example, 14 games, the player then manually writes the date, signs his or her name, and, if desired, completes the indicated locations 38 and 40 as well. The player may then provide the head coach with a photocopy of the completed page 32, or otherwise make that information available to the head coach.

Also included in the gear for each player is a sheet 44 of football markers, a sheet 46 of helmet markers and a sheet 48 of gold shields. The sheet 44 is comprised of a suitable backing sheet 50 and a plurality of labels 52 depicting footballs on one surface and provided with pressure sensitive adhesive on their opposite surface. The labels 52 would preferably be all of the same color, such as pigskin tan. Additionally, the number of labels 52 would preferably be sufficient for a player to complete marking all of the pages 32 of the play action guide 30 in a manner to be described below.

The sheet 46 likewise includes a backing sheet 54 on which are mounted a plurality of labels 56 depicting colored helmets on one surface. All the helmets on a backing sheet 54 would be of the same color and backing sheets for helmets of 12 different colors, for example, are provided in a game kit in keeping with the provision on the scoreboard 20 for 12 different players, for example. When a player selects a particular color for play, he receives a backing sheet 54 with labels 56 having that color. As with the labels 52, the labels 56 are provided with pressure sensitive adhesive on their opposite surfaces. The number of labels 56 is generally consistent with the number of weeks in the season.

In similar fashion, the sheet 48 includes a backing sheet 58 and a label 60, for instance, a gold award label, depicting on one surface the trademark of the game or other suitable notation. Also, in a similar manner, the opposite surface of the label is provided with pressure sensitive adhesive.

While each of the labels 52, 56, and 60 has been disclosed as provided with pressure sensitive adhesive for its attachment to another surface, this need not be the case in all instances. For example, the labels may be attachable to another surface by magnetic, electrical, mechanical, or other suitable means, as desired.

Upon the conclusion of each of the weekly contests, each player may remove a football marker, or label 52, from the backing sheet 50 and apply it to the appropriate boxes 42 on the pages 32 to indicate his or her successful selections. A successful selection occurs when the team selected by the player to win a contest actually does win that contest. Throughout the play of the game of the invention, multiple awards may be granted for tie situations. For purposes of scoring the game being disclosed, one point is awarded for each correct selection. Therefore, the number of labels 52 appearing on a page 32 represents the score awarded to that player for that week.

The head coach then records this score for each of the players on the scoreboard 20 in the indicated location 24. A label 56 belonging to a player with the highest score for that particular week, and having that player's identifying color, is then removed from the backing sheet 54 and applied to the scoreboard 20 at the indicated location 26 for that particular player. Additionally, each player's weekly score as recorded at the indicated location 24 is added to that player's previous total score recorded in the indicated location 26 for the preceding week, then manually written in to the indicated location 26 for the most recent, or current, week.

The game described herein is played in the same manner during the playoffs in post season play except that each correct selection during the playoffs is worth five points, that is, five points for each of the labels 52 applied to the pages 32A, 32B, and 32C of the play action guide 30. Again, the game is played in the same manner for the championship game as in the playoffs except that the correct selection in the championship game is worth ten points. In this instance, each player who selects the championship game winner is also permitted to place a label 60 in an appropriate box 64 on the page 32D which represents the championship game.

Upon the conclusion of the championship game, the head coach completes the scoreboard 20 in the manner previously described, and announces the winner of the game described herein who is the player with the most cumulative points for the season. A gold shield, for example, a most valuable player (MVP) award, such as the label 60, may then be applied to the scoreboard 20 adjacent the winner's name for everyone to see.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A game which combines skill and chance for participation by one or more players who seek to correctly choose, beforehand, the outcomes of actual athletic contests played by a plurality of opposing teams belonging to a league in the course of a playing season which involves weekly contests, playoff contests, and a championship contest, said game of chance comprising:

weekly notation means including a plurality of record means, each record means indicating the opposing teams for each of the weekly contests, the opposing teams for the playoff contests, and the opposing teams for the championship contest, and indicated locations for manually inserting, respectively, the name of the player and the date;

a plurality of first marker means including first indicia thereon and being selectively attachable to said record means for overlying a designated portion of each of said record means for each of the contests scheduled for one week for which a player has successfully chosen the winning team;

board means including a plurality of indicated locations, respectively, for manually inserting the names of each of the players, the total number of successful choices of each player for each successive week, the cumulative successful choices of each player for all of the preceding weeks of the contest season continuing through the playoffs and concluding with the championship contest and including a plurality of reception locations for receiving a plurality of second marker means thereon;

said plurality of second marker means including second indicia thereon and being selectively attachable to said board means for overlying each of said reception locations for which a player has successfully chosen the largest number of winning teams for the week;

whereby the player with the largest cumulative number of successful choices for the playing season is the winner of the game.

2. A game which combines skill and chance as set forth in claim 1 wherein said athletic contests are professional football games; and wherein the league is composed of teams representing a variety of nationally dispersed geographical entities.

3. A game which combines skill and chance as set forth in claim 1 wherein said athletic contests are any one of professional or collegiate football, basketball, hockey, or soccer games;

wherein the league is composed of teams representing a plurality of nationally dispersed geographical entities in the event they are professional games; and wherein the league is composed of teams representing a plurality of geographically dispersed educational institutions in the event they are collegiate games.

4. A game which combines skill and chance as set forth in claim 1 wherein said weekly notation means includes a plurality of pages, one of said pages for each of said record means; and binding means for joining said pages together to form a booklet.

5. A game which combines skill and chance as set forth in claim 1 wherein said record means for the championship contest has another reception location for receiving third marker means thereon;

said third marker means having third indicia thereon and being selectively attachable to said record means for overlying said another reception location for indicating the winner of the game.

6. A game which combines skill and chance as set forth in claim 5 including:

support means for releasably supporting each of said first, second, and third marker means.

7. A game which combines skill and chance as set forth in claim 5 including support means for releasably supporting each of said first, second, and third marker means; and wherein said first indicia includes a pictorial representation of a football; and wherein said second indicia includes a pictorial representation of a helmet indicative of of each of the teams in the league; and wherein said third indicia includes a representative of a shield depicting a trademark of the game; and wherein each of said marker means includes attachment means, on a surface opposite said indicia, for initial releasable attachment to said support means and subsequent, selective, attachment, respectively, to said record means for the weekly contests, to said board means, and to said reception location of said record means for the championship contest.

8. A game which combines skill and chance as set forth in claim 7 wherein said support means for said first indicia is a backing sheet having sufficient size to releasably receive thereon a complete set of said pictorial representations of footballs thereon for application to all of said record means;

wherein said support means for said second indicia is a backing sheet having sufficient size to releasably receive thereon a complete set of said pictorial representations of helmets thereon representing all of the teams in the league; and wherein said marker means are composed of sheet material.

9. In a game combining skill and chance for participation by one or more players who seek to successfully choose, beforehand, the outcomes of actual athletic contests played by a plurality of opposing teams belonging to a league in the course of a playing season which involves weekly contests, playoff contests, and a championship contest, said game of chance including a plurality of record means, each record means indicating the opposing teams for each of the weekly contests, the opposing teams for the playoff contests, and the opposing teams for the championship contest, and indicated locations for manually inserting, respectively, the name of the player and the date, and a board means including a plurality of indicated locations, respectively, for manually inserting the names of each of the players, the total number of successful choices of each player for each successive week, the cumulative successful choices of each player for all of the preceding weeks of the contest season continuing through the playoffs and concluding with the championship contest, and comprising the steps, for each player, of:

before the contests scheduled for a week occur, marking the record means for each of the weekly contests to indicate the chosen winner;

after all of the contests scheduled for the week have occurred, selectively affixing a first marker means on a designated portion of the record means to indicate each of the successful choices;

after all of the contests scheduled for the week have occurred, selectively affixing a second marker means on the board means to indicate the player who has selected the most successful choices; and after all of the contests scheduled for the week have occurred, manually inserting on the board means the total number of successful choices for the week, the cumulative successful choices for all of the preceding weeks of the contest season continuing through the playoffs and concluding with the championship contest.

10. A game combining skill and chance as set forth in claim 9 including the steps of:

after the championship contest, selectively affixing a third marker means on another designated portion of the record means to indicate the player who has selected the winner of the championship contest.

11. A game combining skill and chance as set forth in claim 9 wherein the athletic contests are professional football games; and wherein the league is composed of teams representing a variety of nationally dispersed geographical entities.

12. A game combining skill and chance as set forth in claim 9 wherein the first marker means includes a pictorial representation of a football; and wherein the second marker means includes a pictorial representation of a helmet indicative of each of the teams in the league; and wherein the third marker means includes a representation of a shield depicting a trademark of the game.

* * * * *